US005111747A

United States Patent [19]

Kobler et al.

[11] Patent Number: 5,111,747

[45] Date of Patent: May 12, 1992

[54] CHAMBERED DOCTOR BLADE INKER SYSTEM

[75] Inventors: Ingo Kobler, Anhausen; Thomas John, Augsburg; Franz X. Gollinger, Hirschbach; Georg Bock, Augsburg, all of Fed. Rep. of Germany

[73] Assignee: Man Roland Druckmaschinen AG, Offenbach am Main, Fed. Rep. of Germany

[21] Appl. No.: 584,249

[22] Filed: Sep. 18, 1990

[30] Foreign Application Priority Data

Oct. 13, 1989 [DE] Fed. Rep. of Germany ... 8912194[U]

[51] Int. Cl.[5] ..... B41F 31/00

[52] U.S. Cl. ..... 101/365; 101/157; 101/350

[58] Field of Search ..... 101/350, 352, 157, 169, 101/363, 364, 365, 366, 367

[56] References Cited

U.S. PATENT DOCUMENTS

| | | | |
|---|---|---|---|
| 3,500,745 | 3/1970 | Neal | 101/207 |
| 3,921,525 | 11/1975 | D'Amato et al. | 101/315 |
| 4,009,657 | 3/1977 | Bonanno et al. | 101/157 |
| 4,244,292 | 1/1981 | Williams et al. | 101/364 |
| 4,401,031 | 8/1983 | Buan | 101/363 |
| 4,481,883 | 11/1984 | Savart et al. | 101/365 |
| 4,617,865 | 10/1986 | Switall | 101/367 |
| 4,625,643 | 12/1986 | Davis | 101/169 |
| 4,938,133 | 7/1990 | Book et al. | 101/349 |
| 4,987,831 | 1/1991 | Weder | 101/365 |

FOREIGN PATENT DOCUMENTS

| | | |
|---|---|---|
| 184191 | 12/1955 | Austria . |
| 0258519 | 3/1988 | European Pat. Off. . |
| 278225 | 8/1988 | European Pat. Off. . |
| 456308 | 2/1928 | Fed. Rep. of Germany . |
| 1313431 | 3/1966 | Fed. Rep. of Germany . |
| 2055897 | 5/1972 | Fed. Rep. of Germany . |
| 3800412 | 7/1989 | Fed. Rep. of Germany . |
| 3838546 | 7/1989 | Fed. Rep. of Germany . |
| 434107 | 5/1934 | United Kingdom . |

OTHER PUBLICATIONS

"Der Polygraph", vol. 13-88, p. 1103.

"Der Polygraph", vol. 14, 1963, pp. 897-899.

*Primary Examiner*—Edgar S. Burr

*Assistant Examiner*—Ren Yan

*Attorney, Agent, or Firm*—Frishauf, Holtz, Goodman & Woodward

[57] ABSTRACT

The chambered doctor blade unit has an anilox roller against which a doctor blade can be engaged. An ink trough, and an arrangement to transport ink from the ink trough to a chambered doctor blade unit or an ink application roller is provided, the chambered doctor blade unit or the ink application roller being, respectively, operatively coupled with the anilox roller. The ink supply trough, the ink application device, the doctor blade and the ink trough form a single structural unit which is located on a carrier structure on the printing machine, to be removable as a unit. A plurality of units are severably coupled to a common ink pump shaft on the printing machine. The printing machine carrier structure may be pivotable so that the entire unit can be pivoted away from an ink application roller of the printing machine, or away from the anilox roller; or, alternatively, the anilox roller and the support structure therefor may also form part of the single structural unit so that the entire inker can be removed as a unit, for example for exchange with inkers having different colors or different inks, and requiring anilox rollers of different surface configuration.

12 Claims, 4 Drawing Sheets

CHAMBERED DOCTOR BLADE INKER SYSTEM

Reference to related patent and application, assigned to the assignee of the present application, the disclosures of which are hereby incorporated by reference:

U.S. Pat. No. 4,938,133, BOCK, GOLLINGER and JOHN

U.S. Ser. No. 07/403,754, filed Sep. 6, 1989, JOHN, now U.S. Pat. No. 4,998,475

U.S. Ser. No. 07/403,620, filed Sep. 6, 1989, BOCK et al., now U.S. Pat. No. 4,964,336.

Reference to related publications:

"Der Polygraph", Vol. 13-88, page 1103;

"Der Polygraph", Vol. 14, 1963, pages 897-899

German Patent 1,213,431, Bayer et al.

FIELD OF THE INVENTION

The present invention relates to a short ink train inker, and more particularly to such an inker having a doctor blade which is engageable with an anilox roller, and an arrangement to supply ink thereto.

BACKGROUND

The referenced literature "Der Polygraph", 13-88, page 1103, illustrates an inker of this type. It uses separate holders for the portion of the chambered doctor blade which carries the doctor blade itself and the ink trough with ink supply apparatus therefor. Likewise, the referenced U.S. Pat. No. 4,938,133 illustrates such an arrangement in which the chambered doctor blade unit can be readily removed from the machine. The referenced literature "Der Polygraph", Issue 14, 1963, pp. 897-899, and German Patent 1,213,431, Bayer, assigned to the assignee of the present application, which describes in patent format essentially the structure of the literature reference "Der Polygraph", issue 14, shows an arrangement in which a doctor blade is pivotable about bolts which, in turn, are secured to a fixed carrier element. The doctor blade can be flipped upwardly, for example for cleaning. This retains the adjustment of the doctor blade, and, even if the chambered ink unit is exchanged, the doctor blade adjustment remains, since the entire control arrangement for the doctor blade is a unit, separate from the remaining elements of the inker. The inker chamber and the doctor blade, thus, do not form a unitary structure.

The literature reference "Der Polygraph", vol. 13, shows a similar inker system in which the doctor blade and an ink trough with ink supply elements are separate structures. Two separate holder arrangements are necessary, and each time that the ink is to be changed, for example to change color, it is necessary to disassemble, separately, the doctor blade unit and the ink trough. For replacement with an inker holding differently colored ink, a different chambered doctor blade unit and ink trough must, separately, be re-assembled.

THE INVENTION

It is an object to simplify the inking of an inker roller having cells, typically an anilox roller, in which exchange of ink can be carried out rapidly, by an inker system which is so constructed that the holding arrangement of replaceable parts of the inker on the printing machine itself are simplified.

Briefly, a supply ink trough, an ink application element, the doctor blade, and an ink transporting arrangement form a single structural unit. A carrier structure is provided on the printing machine for releasably supporting a plurality of such single structural units, selectively, in predetermined position or, if desired, any one being removable as a unit from the carrier structure and severable from a common inker pump drive shaft.

DRAWINGS

DETAILED DESCRIPTION

Figure 2:
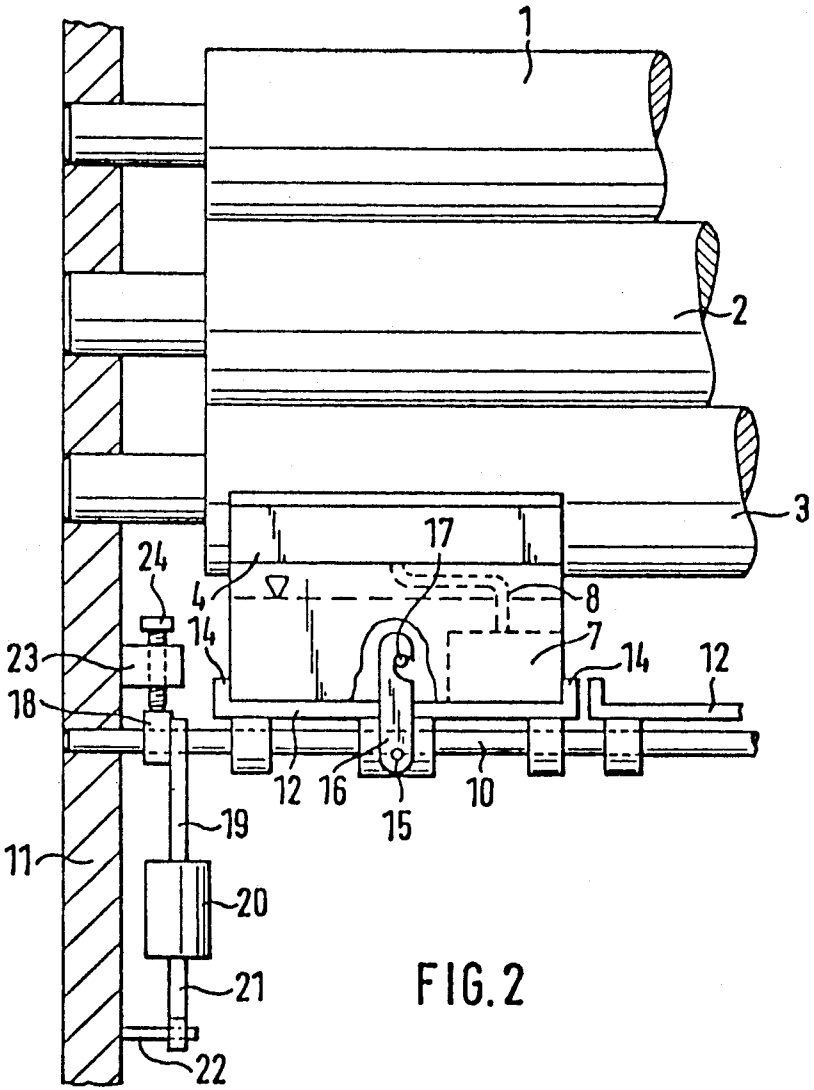
FIG. 2 is a view of the system of FIG. 1 in the direction of the arrow II.
Figure 1:
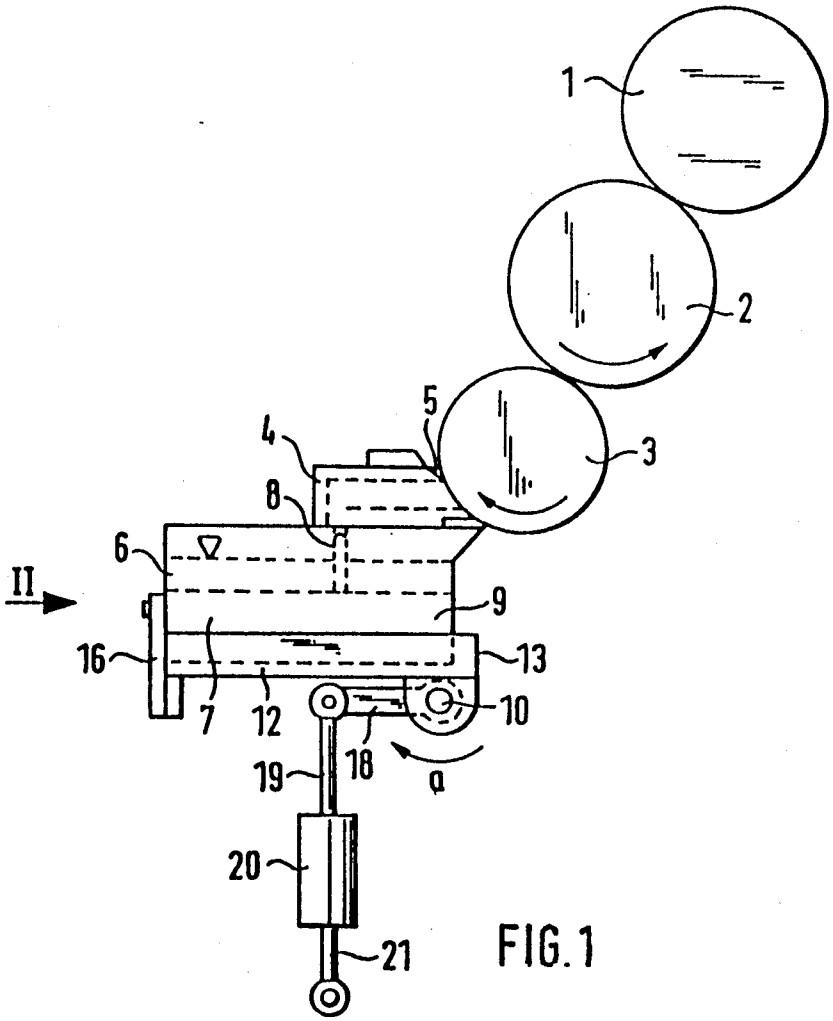
FIG. 1 is a highly schematic side view of an inker system for a printing machine, and illustrating a first embodiment of the invention.

Referring first to FIGS. 1 and 2:

A plate cylinder 1 receives ink from an ink application roller 2. Plate cylinder 1 and the ink application roller 2, for example, have the same diameter. Ink application roller 2 has a yielding, ink accepting surface. The ink application roller 2 is in surface contact engagement with an anilox roller 3, which has a hard surface formed with small cells. The plate cylinder 1, the ink application 2 and the anilox roller 3 are rotatably retained between side walls 11 of the printing machine; only one side wall 11 is shown, and the right side portion of the roller, and the structure, can be the mirror image to that illustrated in FIG. 2. The anilox roller 3 is operatively coupled to a chambered doctor blade unit 4, having an operating or working doctor blade 5. The unit 4 is securely seated on an ink trough 6. A pump 7 is located in the ink trough 6, which supplies ink from the trough 6 through a connecting or coupling line 8 to the chamber of the chambered doctor blade unit 4. A motor 9, preferably an electric motor, is located in or on the ink trough 6 to drive pump 7. As can be seen, the doctor blade unit 4, together with the blade element 5, as well as the ink trough 6, pump 7, and motor 9, form one structural unit.

The structural unit is secured to the printing machine by being retained and located on a cross element or cross bar or rod or rail 10. The ends of the bar or rod 10 are rotatably held in the side walls 11 of the printing machine. A plurality of support brackets 12 are secured on the rod 10. Each one of the brackets 12 has a rear abutment strip or rail 13 (FIG. 1) and two lateral engagement rails or strips or flanges 14 (FIG. 2), so that the ink trough 6 can be securely and positively positioned between the abutment strips or flanges 13, 14. A latch lever 16, rotatable about an axis or shaft 15, is located at the front side of the bracket 12. The latch lever 16 is formed with a hook-like recess, which can engage about a pin 17 projecting from the front wall of the ink trough 6. A positioning lever 18 is secured to the cross rod or cross element 10. A pneumatic or hydraulic, or otherwise preferably power-operated positioning element 20 is coupled to the free end of the lever 18. Typically, the positioning element will be a pneumatic or hydraulic operating cylinder. The operating cylinder 20 is coupled by a retaining rod 21 to a projecting pin 22, secured to the side wall 11. A stop 23 is secured to the side wall 11, through which a positioning screw 24 is screwed. The positioning screw 24 limits the pivoting path of the positioning lever 18 in the direction of the arrow a (FIG. 1) and hence defines the engagement path of the doctor blade 5, and the spacing of the doctor blade 5 with respect to the anilox roller 3. Preferably, the positioning arrangement, at least including the bracket 23 and the adjustment screw 24, is also provided at the opposite side wall (not shown) of the printing machine. The entire operating system can also be duplicated.

Operation

The unit 4, 5, 6, 7, 9 can readily be exchanged as a single structure. To exchange this unit, the operating element, that is, cylinder 20, is so operated that the cross element 10 is rotated counter the direction of the arrow a, so that the chambered doctor blade unit, and hence the doctor blade 5, is lifted off and away from the anilox roller 3. Thereafter, the latch between the parts 16, 17 is released by pivoting the latch lever 16 in counter-clockwise (CCW) direction and the unit formed by the doctor blade structure 4, trough 6, pump 7 and motor 9 can be lifted off the carrier bracket 12.

To re-install the inker unit, for example with ink of a different color, the reverse sequence is followed.

In dependence on the size and type and use to which the printing machine is to be put, a single structural unit can be used to extend over the entire axial length of the respective rollers 1, 2, 3, or at least over the length of the anilox roller 3. It is also equally possible to so construct the chambered doctor blade units and the carrier elements or brackets 12 that a plurality of laterally adjacent units can be placed thereon, for example carrying differently colored inks.

Figure 3:
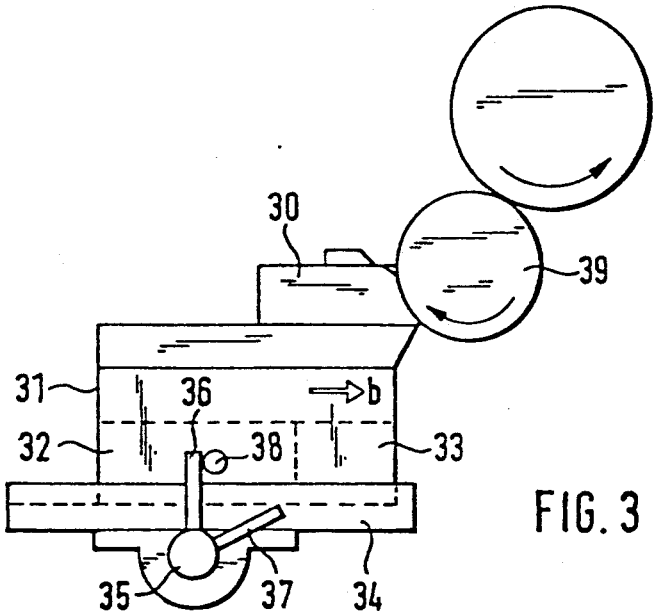
FIG. 3 is a side view of another embodiment of an inker.

Embodiment of FIG. 3

A unit including a chambered doctor blade structure 30, an ink trough 31, pump 32 and a motor 33 is used; however, and differing from the embodiment of FIGS. 1 and 2, a fixed support 34 is provided, secured to the side walls (not shown) of the printing machine. A positioning shaft 35 is located in the support 34. The positioning shaft 35 carries the ink trough 31. The shaft 35 carries two positioning arms 36, 37 located laterally of the ink trough 31. The positioning arms 36, 37 are operatively associated with a pin or stub 38, secured to the outside of the ink trough 31.

Operation, FIG. 3

In the position shown in FIG. 3, the chambered doctor blade unit 30 is engaged by the arm 36 against an anilox roller 39, by rotation of the shaft 35, which moves the arm 36 in the direction of the arrow b. Upon rotation of the positioning shaft 37 in CCW direction, positioning arm 37 will engage the pin 38 and pull the units 30, 31, 32, 33 opposite the direction of the arrow b from the anilox roller 39. The entire unit can then be removed from the printing machine, for example for replacement with another one.

The positioning arms 37 are not strictly necessary since the removal of the unit can be carried out manually, after rotation of the shaft 35 in CCW direction to release the stub 38 from engagement with the positioning arm 36.

Figure 4:
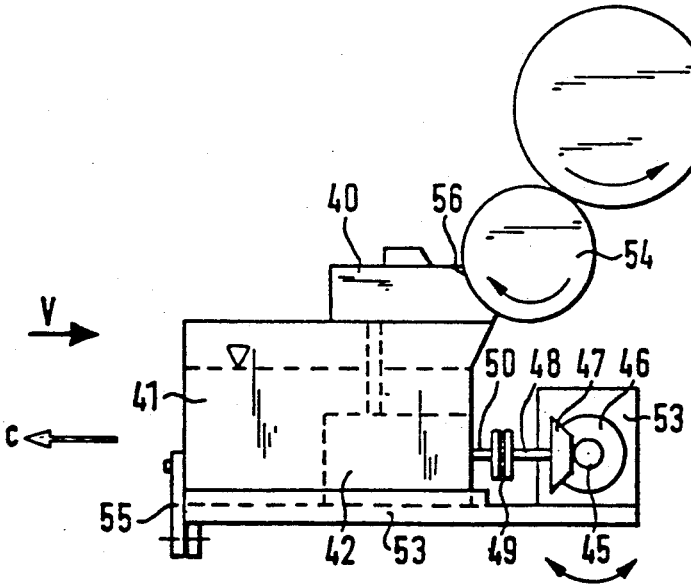
FIG. 4 is a side view of yet another embodiment of an inker.
Figure 5:
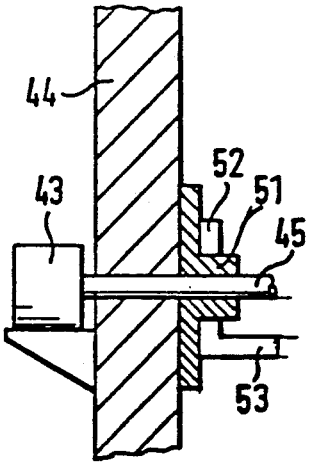
FIG. 5 is a fragmentary view of the inker of FIG. 4, in the direction of the arrow V.

Embodiment of FIGS. 4 and 5

A structural unit is provided formed by a chambered doctor blade unit 40, ink trough 41 and pump 42. The pump is driven by a motor 43, which may be common to a number of such units, and is secured to a side wall 44 of the printing machine. Motor 43 drives a shaft 45 which has one or more bevel gears 46 seated thereon, each one adapted to drive a pump 42 of the respective units. The bevel gear 46 is in engagement with a similar bevel gear 47 on the respective unit, secured to a drive shaft 48. The drive shaft 48 is coupled to half of a releasable clutch 49; the other half of the releasable clutch is secured to the shaft 50 of the pump.

Each one of the side walls 44 (FIG. 5) retains a bushing 51, on which a flange 52 of a carrier cross element 53 is located. The cross element carrier 53 is used to retain the chambered doctor blade 40, ink trough 41, pump 42, pump shaft 50 and associated half of the clutch 49, as a unit. Upon rotation or pivoting of the carrier 53, the structural unit 40–42, 50 can be engaged so that the doctor blade 56 will be placed in operative relationship to the anilox roller 54 or, respectively, can be removed therefrom. Simultaneously, the clutch halves of the clutch 49, are selectively placed in engagement. The structural unit 40–42 is secured to the carrier 53 by a latch lever 55 which can be similar, for example, to the latch lever 16 of FIGS. 1 and 2. The carrier 53 is pivoted about the bushing 51, for example manually or by a power pivoting arrangement 18, 19, 20 similar to that illustrated in FIGS. 1 and 2.

Operation, FIGS. 4 and 5

To remove the structural unit 40–42, 56, the carrier 53 is pivoted over a short arc in CCW direction and the latch 55 is then released. The entire unit 40, 42, 56 can then be removed in the direction of the arrow c from the carrier 53, by sliding it off. This also disengages the halves of the clutch 49. To assemble a unit, one proceeds in inverse sequence.

Figure 6:
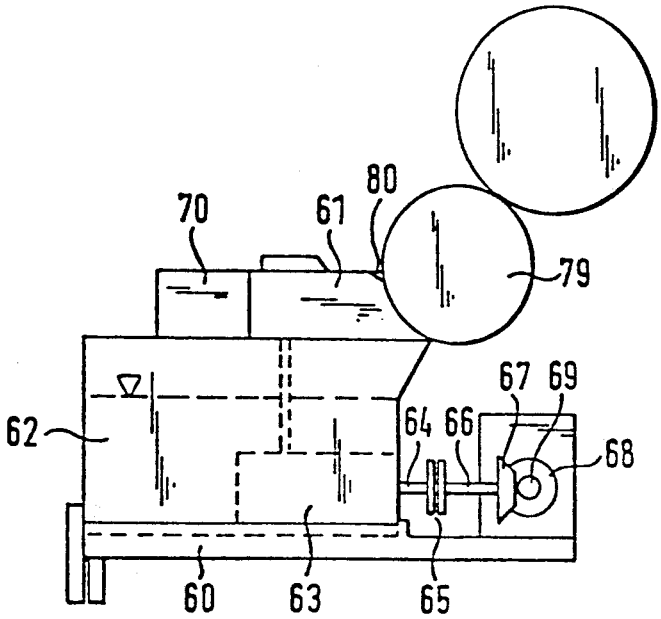
FIG. 6 is a schematic side view of yet another embodiment of the inker.
Figure 7:
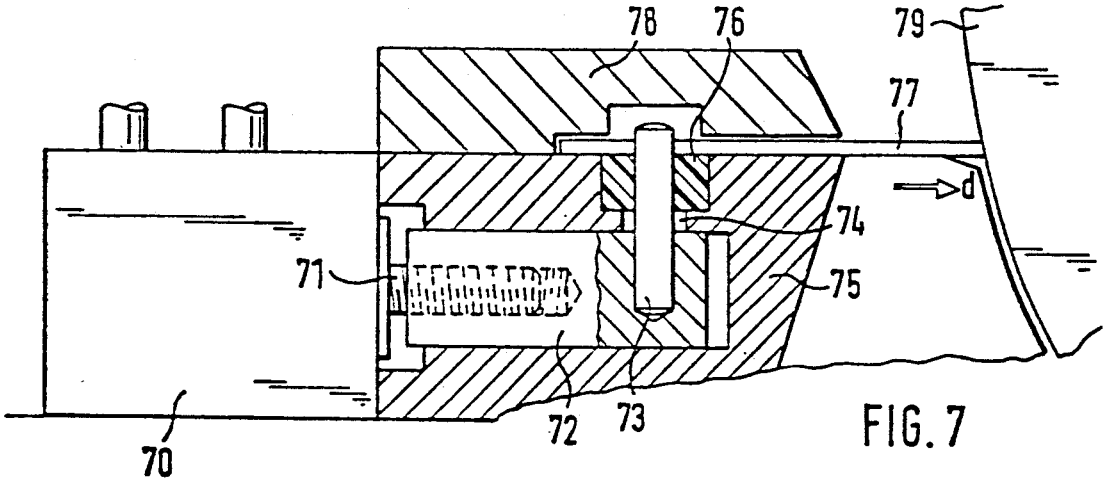
FIG. 7 is a fragmentary greatly enlarged view of a portion of the inker of FIG. 6.

Embodiment of FIGS. 6 and 7

A fixed carrier support 60 is used, secured with its side walls in any suitable manner on the side walls 11 of the printing machine. A group of integral operating units can be placed on the support carrier 60. These units includes the chambered doctor blade 61, having the doctor blade element 80, ink trough 62 and a pump 63, which is coupled to a pump shaft 64. The pump shaft 64 terminates in one half of a releasable clutch 65. Clutch 65 is coupled via a clutch shaft 66 which, in turn, is engaged via bevel gears 67, 68 with a main drive shaft 69. The drive shaft 69 can be suitably rotatably retained in the side walls of the printing machine, and driven by a motor, for example as described in connection with FIGS. 4 and 5.

The embodiment of FIGS. 6 and 7 includes an arrangement for fine adjustment of the doctor blade 77 (FIG. 7). It is shown, for simplicity, in connection with the embodiment shown in FIG. 6, although the fine adjustment of the doctor blade can be used in any one of the embodiments if additional fine adjustment arrangements for the doctor blade are desired. Fine adjustment of the doctor blade, in any one of the embodiments, can be obtained by providing an additional positioning element 70 which is secured to the doctor blade unit 61 or the ink trough 62 in accordance with engineering requirements, as desired. The positioning element 70 has a projecting positioning spindle 71 which is engaged with a slider 72. The slider 72 has a pin 73 fitted therein. Pin 73 passes through a longitudinally elongated slit 74. The free end of the pin 73, projecting from the slider 72, passes through an elastic seal 76 and is fitted in a press fit, or interference fit, in a suitable opening of the doctor blade 77. The doctor blade 77 is retained by a clamping jaw 78 against the housing 75 of the doctor blade 61. It can be shifted backwards and forwards, in accordance with the arrow d.

Operation, Embodiment of FIG. 7

The doctor blade 7 is engaged against the anilox roller 79 by individual adjustment thereof, that is, by rotating the spindle 71, and thereby shifting the doctor blade, for example away from the anilox roller 79, counter the direction of the arrow d.

Figure 9:
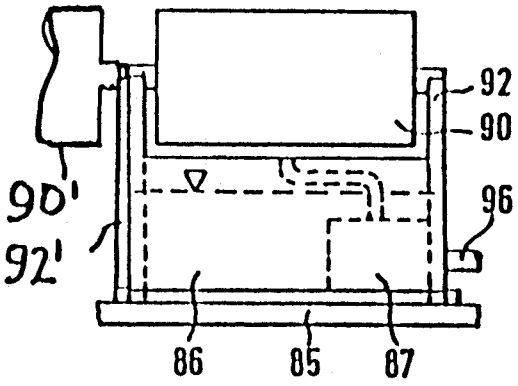
FIG. 9 is a view of the system of FIG. 8 in the direction of the arrow IX of FIG. 8.
Figure 8:
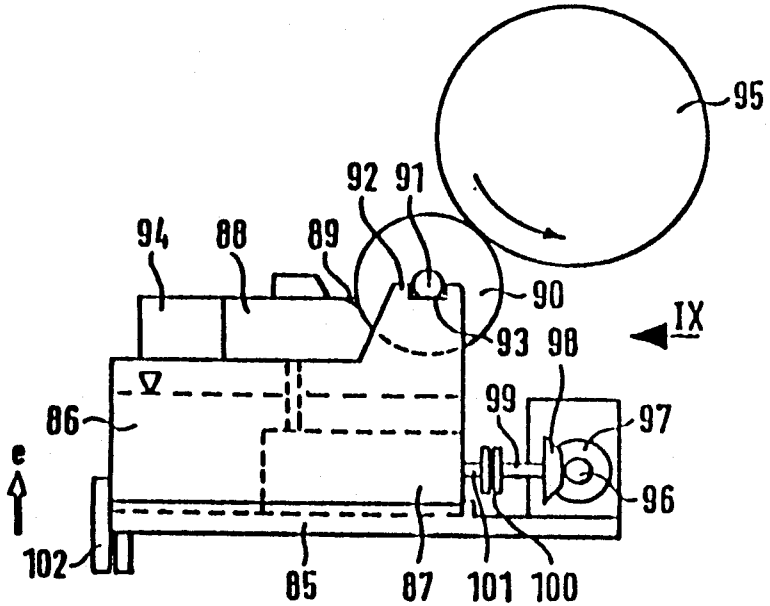
FIG. 8 is a side view of a further embodiment of the invention.

Embodiment of FIGS. 8 and 9

A pivotably secured cross carrier 85 is constructed, similar to the arrangement shown in FIGS. 4 and 5. A unit which includes an ink trough 86, pump 87, chambered doctor blade 88 with a doctor blade element 89, can be placed on the carrier 85. The doctor blade 89 can be put in engagement with an anilox roller 90. The anilox roller 90 is rotatably retained for rotation about a shaft 91 (FIG. 8). The shaft 91, in turn, is retained in fork-like holders 92 in the side walls of the printing machine. To prevent rotation of the shaft 91, it is formed with a flattened surface 93 in the region of the fork-shaped recess of the holder 92. The unit 86-89 can, additionally, include a positioning element 94 which can be constructed similarly to the positioning element 70 (FIG. 7), for example to individually adjust the position of the doctor blade 89 against the anilox roller 90.

The pump 87 can be driven by drive shaft 96, coupled to two bevels gears 97, 98 which, in turn, drive a shaft 99. A clutch 100 has one clutch half coupled to drive shaft 99, and the other clutch half to the pump shaft 101. A latch lever 102 locks the unit 86-90 in position.

Operation

Upon pivoting the carrier 85 in the direction of the arrow e, anilox roller 90 is engaged with the ink application roller 95. Upon tipping the carrier 85 in the opposite direction, the anilox roller 90 is lifted off the ink application roller 95, and in this position, the entire unit, including the anilox roller 90, can be exchanged.

This arrangement also permits placing a plurality of units 86-90 adjacent each other, so that different colors can be printed from different axial zones of a printing plate. The arrangement facilitates the exchange of the anilox roller 90, since it can be removed, as a unit, from the printing machine. This is of particular importance when it is desirable to use different cell distributions or different cell sizes for different printing inks, or differently colored printing inks. Thus, in very simple manner, different colors with different anilox roller of different cell distribution, pattern or size can be provided, and, further, exchange of only the anilox roller of any one unit is particularly simple. FIG. 9 also, schematically, illustrates the placement of a plurality of adjacently located units. It is only necessary to construct one of the supports 92 of double width, or to add another support 92', to place another anilox roller 90', for example differing in cell distribution, raster or size from the anilox roller 90, on the support. The inking system 86-89 has been omitted from the second anilox roller 90', for clarity of the drawing.

Figure 10:
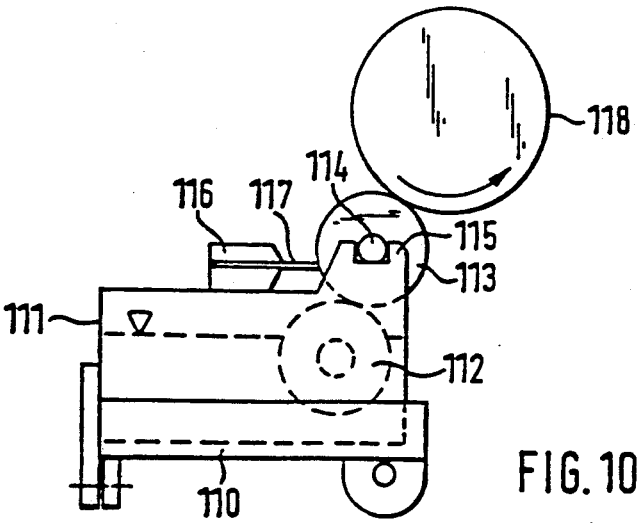
FIG. 10 is a schematic side view of yet another embodiment of the invention.

Embodiment of FIG. 10

A pivotable support 110 is provided which can be similar to the support 12 (FIGS. 1 and 2), for pivoting in the same manner. An ink trough 111 is placed on the support 110. A duct roller 112 is located within the trough 111, at least partly immersed in the ink, the level of which is indicated by the broken line within the trough. The duct roller 112 is operatively associated with the anilox roller 113. The anilox roller 113 is rotatable about the shaft 114. Shaft 114 is held in the forked holder 115, similar toi shaft 91, so it cannot rotate within its holder. The holder 115 is securely connected to the trough 111. A clamp holder 116 for a doctor blade 117 is secured to the trough 111.

The anilox roller 113 is operatively associated with an ink application roller 118, suitably rotatably retained in the side walls of the printing machine (not shown). The duct roller 112 can be rotated by friction transferred thereto from the application roller 118 via the anilox roller 113. Of course, the duct roller 112 may be driven independently, for example by an individual motor secured to the ink trough 111. Alternatively, a central drive, such as shown in FIGS. 4 and 5, with clutches, if desired, can be used for the duct roller 112.

In this embodiment, as well as in the others, the ink trough 111, and rollers 112, 113 as well as the doctor blade 117, provide a single exchangeable assembly or unit. This has the particular advantage that the ink trough 111 can have an anilox roller associated directly therewith, so that the ink and the cells of the anilox roller can be directly matched. Upon exchange of color or ink, thus, it is not necessary to separately exchange the anilox roller, since the entire unit, with the roller, can be replaced.

Various changes and modifications may be made, and any features described herein, for example in connection with any one embodiment, can be used with any of the others, within the scope of the inventive concept.

We claim:

1. The combination of a printing machine with a plurality of chambered doctor blade inkers, to apply ink to an anilox roller (54, 79, 90, 90', 113), wherein said doctor blade inkers form integral inker units, wherein said printing machine includes a carrier structure releasably supporting said integral inker units selectively in predetermined positions, removable from said carrier structure;

a main drive shaft (45, 69, 96) extending parallel to the axis of said anilox roller; and motor means (43) coupled to said main drive shaft, wherein at least one of said integral inker units includes a doctor blade (56, 80, 77, 89, 117) positionable against the surface of the anilox roller;

an ink supply trough (41, 62, 86, 111);

an ink application means (40, 61, 88, 112);

means ( 42, 50; 63, 64; 87, 101; 112) including ink pump means (42, 63, 87) for transporting ink from the ink supply trough to said ink application means; and clutch means (49, 65, 100) coupled to said pump means (42, 63, 87), and wherein individual drive connections from said main drive shaft (45, 69, 96) to said integral units are provided, said drive connection comprising first bevel gear means (46, 68, 97) on said main drive shaft (45, 69, 96) and second bevel gear means (47, 67, 98) on said integral inker units and coupled to said clutch means (49, 65, 100), to permit selectively individually coupling said first bevel gear means on said main drive shaft to drive the pump means of any selected unit, and removal of a selected integral unit from said combination by tilting said selected unit about the axis of the main drive shaft and optionally severing the second bevel gear means of the unit from the first bowel gear means on said main drive shaft.

2. The combination of claim 1, wherein said carrier structure includes a movably supported carrier for movably supporting at least one of said integral units.

3. The combination of claim 2, wherein said movably supported carrier is pivotably supported on the printing machine.

4. The combination of claim 1, wherein said integral units are slidably supported on said carrier structure, and said carrier structure is fixedly secured to the printing machine.

5. The combination of claim 1, wherein said ink application means comprises an ink chamber structure which with said doctor blade forms part of said chambered doctor blade inker.

6. The combination of claim 1, wherein said doctor blade is adjustably supported on said ink application means.

7. The combination of claim 6, wherein said ink application means comprises a chambered doctor blade unit; and the doctor blade on at least one of said units is adjustably and movably secured to the respective unit.

8. The combination of claim 1, further including anilox roller support means, said anilox roller support means forming part of said integral unit.

9. The combination of claim 8, wherein said anilox roller support means comprises forked support elements;

an anilox roller shaft is provided on which said anilox roller is rotatably retained; and said anilox roller shaft is supported by said anilox roller support means.

10. The combination of claim 1, wherein said ink transport means comprises a duct roller (112) dipping into ink within the ink supply trough, said duct roller being in operative engagement with said anilox roller (113).

11. The combination of claim 10, further including anilox roller support means, said anilox roller support means forming part of said integral unit.

12. The combination of claim 1, including pump shaft means (50, 64, 101) coupled to the pump means (42, 63, 87) and to the clutch means (49, 65, 100) of a respective inker unit; and connecting shaft means (48, 66, 99) coupling said clutch means to the second bevel gear means (47, 67, 98), wherein said pump shaft means and said connecting shaft means form part of a respective integral inker unit.

* * * * *